US009185774B2

(12) United States Patent
Savage, Jr.

(10) Patent No.: US 9,185,774 B2
(45) Date of Patent: Nov. 10, 2015

(54) SYSTEM AND METHOD FOR DETECTING A PROPERTY OF A STROBE COVER

(71) Applicant: Tyco Fire & Security GMBH, Neuhausen am Rheinfall (CH)

(72) Inventor: Kenneth E. Savage, Jr., Fitchburg, MA (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 54 days.

(21) Appl. No.: 14/098,007

(22) Filed: Dec. 5, 2013

(65) Prior Publication Data

US 2014/0103811 A1 Apr. 17, 2014

Related U.S. Application Data

(63) Continuation of application No. 12/851,958, filed on Aug. 6, 2010, now Pat. No. 8,624,754.

(51) Int. Cl.

| | |
|---|---|
| ***G08B 5/00*** | (2006.01) |
| ***H05B 37/02*** | (2006.01) |
| ***G08B 5/38*** | (2006.01) |

(52) U.S. Cl.

CPC . *H05B 37/02* (2013.01); *G08B 5/38* (2013.01)

(58) Field of Classification Search

CPC ..... F21Y 2101/02; F21K 9/50; F21V 5/04; F21V 5/045; F21V 13/04; H01L 33/58; G08B 5/36; G08B 5/38; G08B 5/00; G08B 7/06; G02B 3/00; G02B 1/04; G02B 1/041; G02B 1/043

USPC ..... 340/506, 6.1–7.63, 815.4–815.92; 359/608, 642; 116/202, 305; 315/11.5; 362/632, 311.01–311.15

See application file for complete search history.

(56) References Cited

U.S. PATENT DOCUMENTS

| | | | |
|---|---|---|---|
| 6,189,808 | B1 | 2/2001 | Daniels et al. |
| 6,927,671 | B2 | 8/2005 | DeBono |
| 7,006,003 | B2 | 2/2006 | Zimmerman et al. |
| 7,278,759 | B2 | 10/2007 | Ziemkowski et al. |
| 2002/0081080 | A1 | 6/2002 | Balle-Petersen et al. |
| 2006/0082995 | A1 | 4/2006 | Chua et al. |
| 2009/0072989 | A1 | 3/2009 | Rock et al. |
| 2009/0309740 | A1 | 12/2009 | Savage |
| 2010/0033319 | A1 | 2/2010 | Pattok et al. |
| 2010/0128446 | A1 | 5/2010 | Dipoala |
| 2010/0191507 | A1 | 7/2010 | Eiden et al. |

*Primary Examiner* — Travis Hunnings
*Assistant Examiner* — Sharmin Akhter
(74) *Attorney, Agent, or Firm* — Brinks Gilson & Lione

(57) ABSTRACT

A method and system for determining at least one property of a strobe cover are disclosed. The determined property of the strobe cover may then be analyzed to determine whether it is the proper property for the strobe device. The property of the strobe cover may include the color of the strobe cover (such as clear, blue, amber, etc.), the shape of the strobe cover (such as a strobe cover with a lens or a strobe cover without a lens), the material of the strobe cover, etc. The method and system may include determining the property of the strobe cover and checking whether the determined property is the expected property of the strobe cover (such as the expected color of the strobe cover). The strobe cover may include one or more property indicators. The one or more property indicators may interface with a circuit, such as mechanically interface with the circuit, in order for the circuit to determine the property of the strobe cover.

20 Claims, 6 Drawing Sheets

SYSTEM AND METHOD FOR DETECTING A PROPERTY OF A STROBE COVER

REFERENCE TO RELATED APPLICATION

This application is a continuation of U.S. application Ser. No. 12/851,958, filed on Aug. 6, 2010, the entire contents of which are incorporated by reference herein.

BACKGROUND

Fire alarm devices such as audible horns (audible/visible or A/V), loudspeakers (speaker/visible or S/V) and visible strobes (visible only or V/O), are referred to as "notification appliances." Typically, a fire alarm control panel (FACP) drives these devices over one or more "notification appliance circuits" (NACs) for non addressable devices or "Signaling Line circuits" in the case of addressable devices. The strobes are required, for example, as an alert for the hearing-impaired, or for those in a high noise environment.

A strobe device is typically made up of a high-intensity Xenon flash tube, an electronic control circuit, a terminal block to connect the device to the NAC, a housing, a strobe reflector assembly, and a transparent protective dome.

The strobe device is a notification device designed to disperse its light output in a predetermined pattern. Further, the strobe may output different colors to signal a different type of alarm. For example, an amber color output of the strobe is indicative of a mass notification output. Thus, the different colors of output light aid in providing more information to occupants of a building. In order to output the desired color, the strobe device can be fitted with a strobe cover of the desired color. However, the strobe cover adds another variable when configuring and maintaining the fire alarm system. Accordingly, a need exists to aid in configuring and maintaining strobe covers for strobes in a fire alarm system.

SUMMARY

The present embodiments relate to methods and systems for determining at least one property of a strobe cover. The determined property of the strobe cover may then be analyzed to determine whether it is the proper property for the strobe device. The strobe cover may cover at least a part of a strobe device, such as at least a part of the strobe of the strobe device. The strobe cover, for example, may be a lens, a cap, or a filter (such as a filter that passes and/or removes certain wavelengths or certain wavelength bands of light). The property of the strobe cover may include the color of the strobe cover (such as clear, blue, amber, etc.), the shape of the strobe cover (such as a strobe cover with a lens or a strobe cover without a lens), the material of the strobe cover, etc. The method and system may include determining the property of the strobe cover and checking whether the determined property is the expected property of the strobe cover (such as the expected color of the strobe cover).

In one aspect, a strobe cover assembly is disclosed that includes a strobe cover with one or more property indicators, and a circuit including at least one element. The indicator (or indicators) on the strobe cover indicates at least one property of the strobe cover. For example, the indicator may include a color indicator (that indicates the color of the strobe cover), a shape indicator (that indicates the shape of the strobe cover), and/or a material indicator (that indicates the material of the strobe cover). The indicator on the strobe cover interfaces with the element in the circuit, such as mechanical interfaces, electrical interfaces, magnetic interfaces, or optical interfaces. The circuit may determine the property of the strobe cover (such as the color, shape, and/or material) of the strobe cover depending on the interfacing of the indicator on the strobe cover with the element in the circuit. For example, the indicator may be placed or positioned on different portions of the strobe cover, with the location of the indicator on the strobe cover signifying to the circuit the property of the strobe cover (such as signifying the color, the shape, and/or the material of the strobe cover).

In another aspect, a strobe device is disclosed that includes a strobe, a controller in communication with the strobe, a strobe cover including at least one indicator, and a circuit for generating an output to send to the controller, the circuit including at least one element, the at least one element interfacing with the at least one indicator in order to generate the output indicative of the property of the strobe cover.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

DETAILED DESCRIPTION

Figure 1:
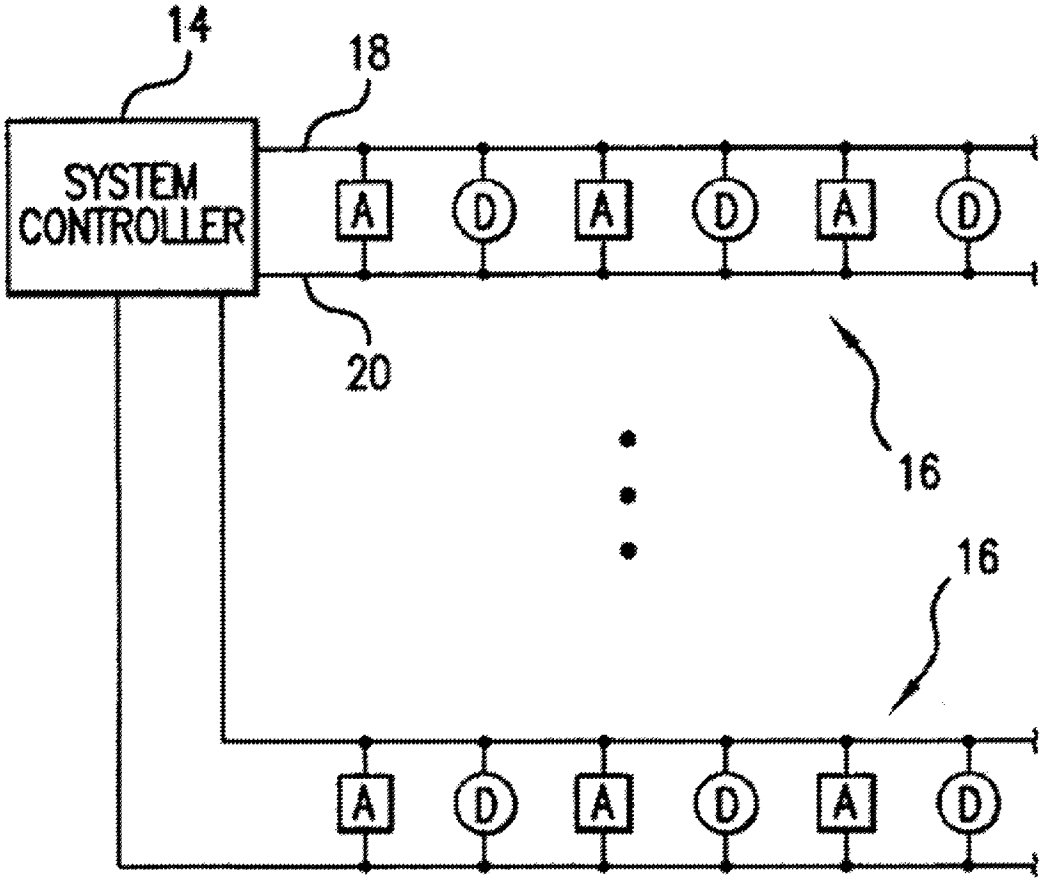
FIG. 1 is a schematic diagram illustrating a fire alarm system.

A system embodying one example of the present invention is illustrated in FIG. 1. The system includes one or more Signaling Line Circuits (SLCs), i.e., networks 16, having alarm condition detectors D and alarm system notification devices A. Alternatively, the detectors and notification devices may be on separate networks. A system controller (such as a fire alarm control panel (FACP) 14) may monitor the detectors D. When an alarm condition is sensed, the fire alarm control panel 14 may signal the alarm to the appropriate notification devices through one or more networks 16. Notification devices may include, for example, a visual alarm (strobe), an audible alarm (horn), a speaker, or a combination thereof.

Although not necessary for carrying out the invention, as shown, all of the notification devices in a network are coupled across a pair of power lines 18 and 20 that advantageously also carry communications between the fire alarm control panel 14 and the detectors D and notification devices A.

The notification devices A may be remotely programmed using the fire alarm control panel 14. In particular, the fire alarm control panel 14 may use one or more of the following: software configuration tools; fire alarm panel displays and keypads or similar user interfaces; service port command; external computer interfaces; Internet interfaces; and modem or other remote connection interfaces.

Commands from the fire alarm panel can, for example, be multiplexed onto the device's power line, providing the added benefit that it saves the cost of additional wiring to devices. Examples of commands issued for a system with addressable notification appliances are disclosed in U.S. Pat. No. 6,426,697, which is hereby incorporated by reference in its entirety. Alternatively, the communication line to the device may be separate from the power line. The communications channel may comprise, for example, a wireless link, a wired link or a fiber optic link.

As another example, the notification devices A may be locally programmed. Specifically, the notification device A may be programmed manually (without its removal) via any of a variety of means, including but not limited to: configuring a switch on the notification device A, jumpers, optical signaling (e.g. TV remote control, blinking flashlight, light bulb or other light source, laser pointers, breaking optical beam), a magnet tapped against the device, radio frequency (RF) tags, sound signaling (e.g. ultrasonic tones, touchtones) etc.

Communication signals to and from the fire alarm control panel 14 may be multiplexed onto the device's power line, or may be on a communication line that is separate from the power line. Alternatively, a fiber optic cable link or a wireless connection can be utilized. Alternatively, or in addition, the notification device A may directly communicate with the fire alarm control panel 14 using for example, optical signaling (for example, an LED, an infrared emitter, etc.). The notification device A may also communicate using other means, such as RF tag reading or audio (e.g., ultrasonic, chirps, beeps, prerecorded or synthesized voice, etc.)

One, some, or all of the notification devices A may comprise a strobe device. One or more of the strobe devices may be locally configured with a strobe cover. The strobe cover may, for example, be a lens or a cap. The strobe cover may also act as a filter that passes and/or removes certain wavelengths or certain wavelength bands of light, so that the strobe device transmits a particular color of light (such as an amber color, a blue color, or a white color). The strobe cover may also have one or more properties, such as the color of the strobe cover (e.g., clear, blue, amber, etc.), the shape of the strobe cover (e.g., a strobe cover with a lens or a strobe cover without a lens), the material of the strobe cover, etc.

For example, the strobe cover may be one of a plurality of colors. As discussed in more detail below, the strobe cover may be installed onto the notification device A through a mechanical connection (such as by using one or more mounting tabs or mounting pins).

Figure 2:
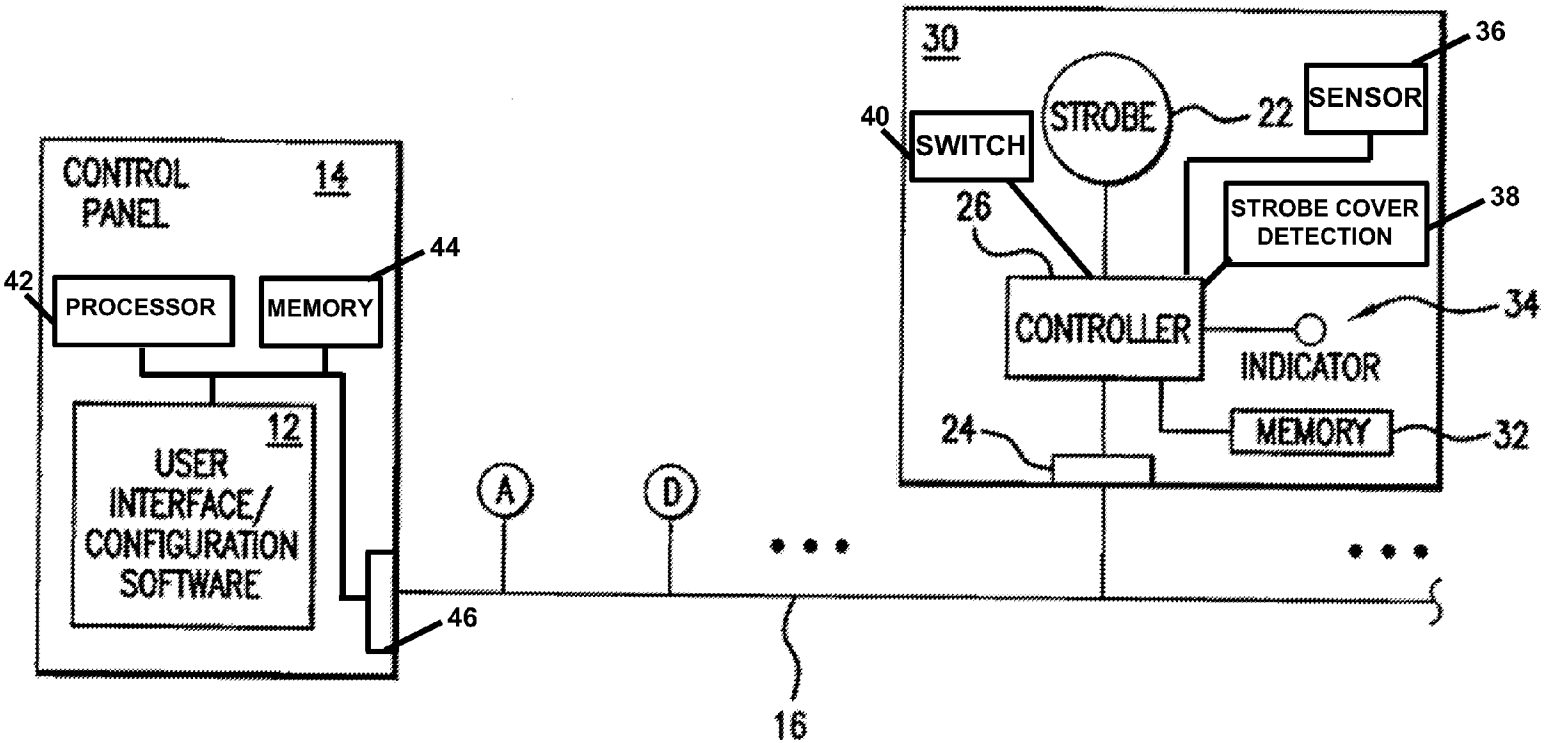
FIG. 2 is a schematic diagram of the system of FIG. 1, further illustrating details of an embodiment of the present invention.

FIG. 2 is a schematic diagram of the system of FIG. 1, further illustrating details of an embodiment of the present invention. For simplicity, the two-line network of FIG. 1 is shown with a single line 16. The fire alarm control panel 14 includes a processor 42, a memory, 44, a user interface and configuration software 12, and network interface 46. The user interface and configuration software 12 in combination with the processor 42 (or other type of controller) allows a user to program the individual strobe devices 30 on the network or communications channel 16. The fire alarm control panel 14 connects to the network 16 via the network interface (communication connection) 46.

Strobe device 30 comprises a network interface 24, a controller 26, a strobe 22, a memory 32, an indicator 34, a sensor 36, a strobe cover detection circuit 38, and a switch 40. The strobe device 30 connects to the network 16 via the network interface (communication connection) 24. The controller 26, such as a microcontroller or hardwired logic, receives commands from and sends data to the fire alarm control panel 14. For example, the fire alarm control panel 14 may send a command to activate the strobe 22 of the strobe device 30. As another example, the fire alarm control panel 14 may send a command to request a response from the strobe device 30, the response including an indication of the property of strobe cover installed in the strobe device 30 (such as the color, the type, and/or the material of the strobe cover), as discussed in more detail in FIG. 7.

When the strobe device 30 receives the command to activate the strobe 22, the strobe 22 flashes. The strobe 22 may comprise a Xenon flash tube or an LED and drive circuitry, or other high-brightness light source. Although shown separately, the memory 32 may be integrated with the controller 26. The indicator 34, such as a flashing LED, may indicate a current configuration of the strobe device 30, for example, upon command from the fire alarm control panel 14, upon a local manual command such as a pushbutton (not shown), on a periodic basis, always, or upon some other event.

Figure 5:
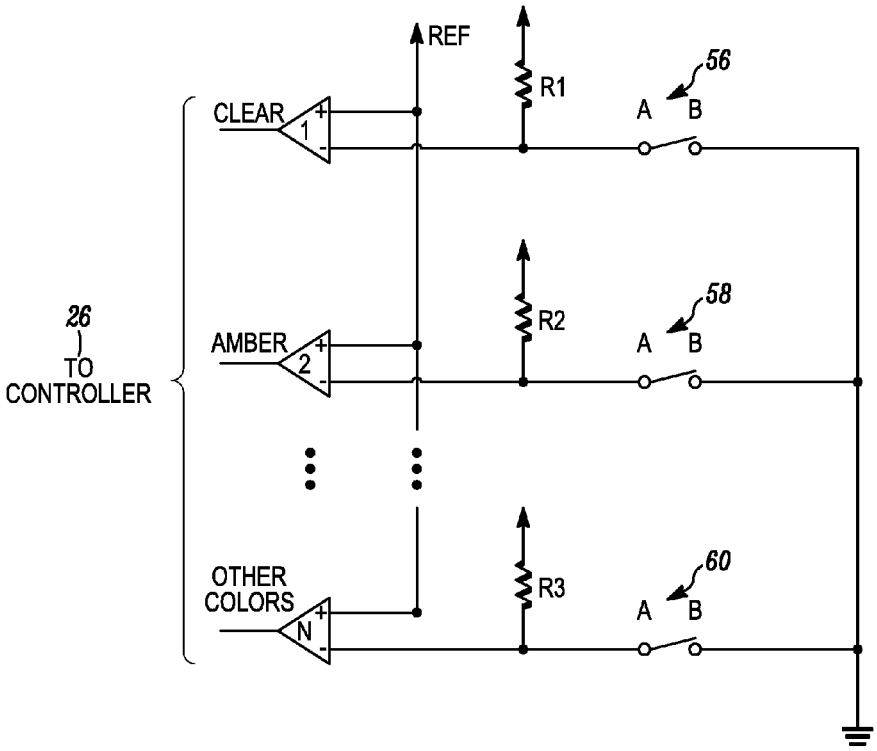
FIG. 5 illustrates an example of a strobe cover detection circuit in which individual dedicated comparators change state when the respective contact is closed.
Figure 6:
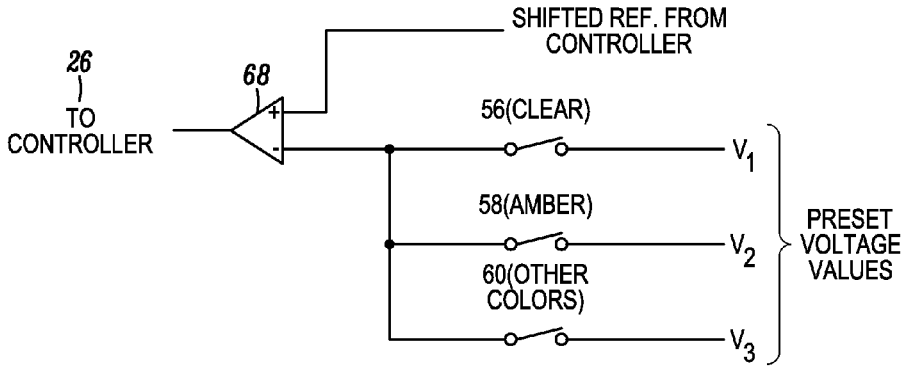
FIG. 6 illustrates another example of a strobe cover detection circuit in which a single comparator monitors a group of contacts against a level shifted reference.

FIG. 2 further includes a strobe cover detection circuit 38. The strobe cover detection circuit 38 may provide an input to the controller 26 of one or more properties of the strobe cover installed in strobe device 30 (such as the color, the type, and/or the material of the strobe cover). The strobe cover detection circuit 38 may interact with the strobe cover in order for the strobe cover detection circuit 38 to determine the one or more properties of the strobe cover (such as the color, the type, and/or the material of the strobe cover). The interaction of the strobe cover detection circuit 38 may comprise mechanical interaction, electrical interaction, optical interaction, magnetic interaction, or any combination thereof, as discussed in more detail below. Examples of the strobe cover detection circuit 38 are depicted in FIGS. 5 and 6. As shown in FIG. 2, the strobe cover detection circuit 38 and the controller 26 are separate elements. Alternatively, the controller 26 may include strobe cover detection circuit functionality, with the controller 26 interfacing directly with the strobe cover.

FIG. 2 also includes a switch 40. The switch 40 may provide an operator a manner in which to manually input the property of the strobe cover installed in the strobe device 30 (such as the color, the type, and/or the material of the strobe cover). For example, the switch 40 may comprise a 2-way switch that includes 2 positions. A first position of the 2-way switch may indicate that the strobe cover is a first color (such as clear), and a second position of the 2-way switch may indicate that the strobe cover is a second color (such as amber). When setting up the strobe device, the operator may install the strobe cover, and may also set the 2-way switch to the appropriate setting. The controller 26 receives an input from the switch 40, the input indicate the setting of the switch 40. As another example, the switch 40 may comprise a 3-way switch includes 3 positions. A first position of the 3-way switch may indicate that the strobe cover is a first color (such as clear), a second position of the 3-way switch may indicate that the strobe cover is a second color (such as amber), and a third position of the 3-way switch may indicate that the strobe cover is a third color (such as blue).

In addition, FIG. 2 includes sensor 36. Sensor 36 may comprise a light sensor for sensing one or more discrete wavelengths or one or more wavelength bands of light. In determining the color of the strobe cover, the controller 26 may command the strobe 22 to generate an output. The sensor 36 may sense the output, including sensing whether the output is at one or more discrete wavelengths or in one or more wavelength bands of light. For example, the controller 26 may control strobe 22 so that strobe 22 outputs light. The sensor 36 may thereafter sense the light after it passes through a part of the strobe cover. Or, a light separate from the strobe 22 (such as another source element) may be used to generate light to pass through the strobe cover. The sensor 36 may then detect light coming from the other source element, passing through the strobe cover (such as through the mounting tab of the strobe cover) and then to the sensor 36. The sensor 36 may communicate the sensed output to the controller 26, which may analyze the communicated sensed output in order to determine the color of the strobe cover. For example, the controller 26 may determine that the sensed output is only at a blue wavelength or only in the blue wavelength band. Based on this, the controller 26 may determine that the strobe cover is the color blue. As another example, the controller 26 may determine that the sensed output is at each of the sensed wavelengths or in each of the wavelength bands. Based on this, the controller 26 may determine that the strobe cover is clear.

Though FIG. 2 depicts sensor 36, strobe cover detection circuit 38, and switch 40, the strobe device 30 may include only include one of those elements (such as only the sensor 36, only the strobe cover detection circuit 38, or only switch 40), may include two of those elements (such as the strobe cover detection circuit 38 and the switch 40), or may include all three of those elements (such as the sensor 36, the strobe cover detection circuit 38 and the switch 40).

Figure 3:
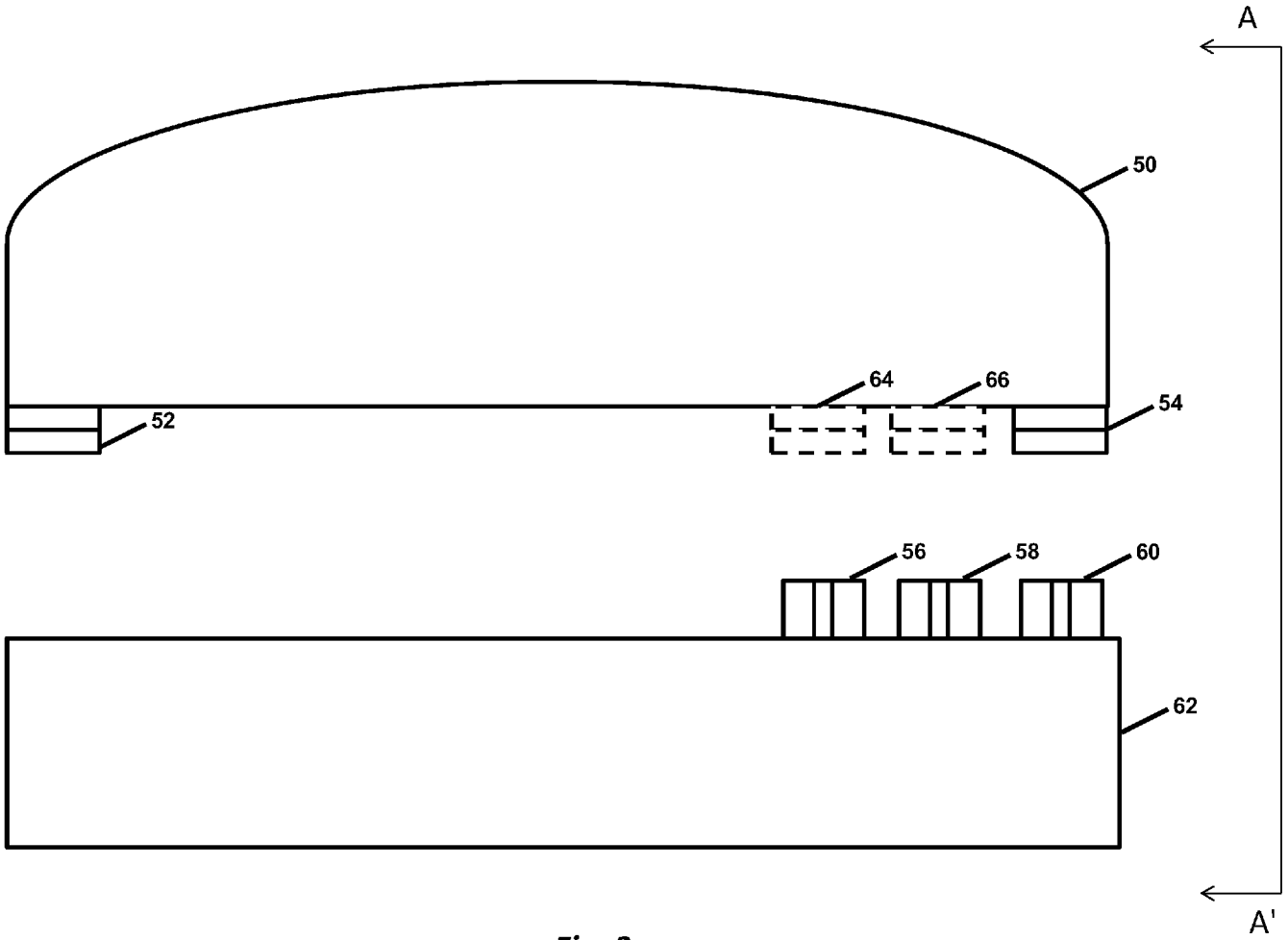
FIG. 3 is a side view of the strobe cover and PCB mating contacts.

FIG. 3 is a side view of the strobe cover 50 and printed circuit board (PCB) electronics 62. The strobe cover 50 may comprise a shaped upper surface, as shown in FIG. 3. Or the strobe cover 50 may comprise a flat upper surface. The strobe cover 50 may further comprise one or more mounting tabs. The strobe cover 50 may include four mounting tabs. Alternatively, more or fewer mounting tabs may be used to affix the strobe cover 50 to a part of the strobe device 30 (such as to PCB electronics 62). FIG. 3, illustrating a side view, depicts two mounting tabs 52, 54 (or other type of mounting pins) on a bottom surface of strobe cover 50. Alternatively, the one or more mounting tabs 52, 54 may be placed on a side surface of strobe cover 50.

One or more of the mounting tabs 52, 54 may interface with a part of base of the strobe device 30, such as PCB electronics 62 on an upper surface of the base of the strobe device 30. The one or more mounting tabs 52, 54 may be part of the strobe cover, either integral with the strobe cover 50 or attached to the strobe cover 50. In one embodiment, the one or more mounting tabs 52, 54 may mechanically interact with a portion of the base of the strobe device 30, such as a contact on the PCB electronics 62. The PCB electronics 62 (and the contacts on the PCB electronics 62) may be mounted to the housing of the strobe device 30, so that when the mounting tabs 52, 54 mechanically interact with the contacts, the strobe cover 50 may be provided with additional structural support. The mechanical interaction of the mounting tab with the contact may comprise the mounting tab opening the contact or closing the contact. In this way, the PCB electronics 62 may be configured to monitor for a normally-open or normally-closed contact in order to determine the property of the strobe cover (such as the color, shape or type of the strobe cover), as discussed in more detail below.

Alternatively, the strobe cover may electrically interact with the PCB electronics in order for the PCB electronics to determine the property of the strobe cover (such as the color, the type, and/or the material of the strobe cover). For example, the strobe cover may have a metallic or other conductive material placed on different portions of the strobe cover in order to indicate different properties of the strobe cover (such as different colors, different types, and/or different materials of the strobe cover). The PCB electronics may include multiple sets of contacts placed in different sections of the upper surface of the PCB electronics. Each set of contacts may normally not be electrically conductive. The conductive material may electrically connect a set of contacts, such as electrically connect the two contacts in the set of contacts, thereby indicating a particular property of the strobe cover to the controller 26 (such as a particular color, a particular type, and/or a particular material of the strobe cover).

In an alternate embodiment, the strobe cover may optically interact with the PCB electronics in order for the PCB electronics to determine the property of the strobe cover (such as the color, the type, and/or the material of the strobe cover). For example, the PCB electronics may include one or more optical sensors. The strobe cover may be designed such that a different property strobe cover blocks a different one of the optical sensors on the PCB electronics. In this way, the optical sensor that is blocked may indicate the property of the strobe cover (such as the color, the type, and/or the material of the strobe cover).

In still an alternate embodiment, the strobe cover may magnetically interact with the PCB electronics in order for the PCB electronics to determine the property of the strobe cover (such as the color, the type, and/or the material of the strobe cover). For example, a magnet may be placed on different portions of the strobe cover in order to indicate different properties of the strobe cover (such as different colors, different types, and/or different materials of the strobe cover). The PCB electronics may include one or more magnetic sensors (such as one or more Hall effect sensor) in order to interact with the magnet that is attached to the strobe cover. The one or more Hall effect sensors may vary its output voltage based on whether the magnet is proximate to or touching the Hall effect sensor.

As shown in FIG. 3, there are a plurality of contacts 56, 58, 60 on PCB electronics 62. Depending on the placement of the mounting tab, the mounting tab mechanically interfaces with a different one of the contacts 56, 58, 60. This is depicted in FIG. 3 with solid mounting tab 54 designed to interface with contact 60, and with dashed mounting tabs 64, 66, in which mounting tab 64 is designed to interface with contact 56, and in which mounting tab 66 is designed to interface with contact 58.

Thus, the mounting tab may be placed in different locations on the strobe cover 50 to indicate a different property of the strobe cover 50, such as a different color of the strobe cover 50. For example, the placement of mounting tab 54 (shown in solid line in FIG. 3) may indicate a clear strobe cover. When installed, the mounting tab 54 interfaces with contact 60. And, the PCB electronics determines that if the contact 60 interfaces with mounting tab 54, the PCB electronics may determine that the strobe cover color is clear, as discussed in more detail below. As another example, the placement of the mounting tab in position 64 (shown in dashed line in FIG. 3) may indicate an amber strobe cover. When installed, the mounting tab 64 interfaces with contact 56. And, the PCB electronics determines that if the contact 56 interfaces with a mounting tab, the PCB electronics may determine that the strobe cover color is amber, as discussed in more detail below. As still another example, the placement of the mounting tab in position 66 (shown in dashed line in FIG. 3) may indicate a blue strobe cover. When installed, the mounting tab 66 interfaces with contact 58. And, the PCB electronics determines that if the contact 58 interfaces with a mounting tab, the PCB electronics may determine that the strobe cover color is blue, as discussed in more detail below. In this way, the PCB electronics 62 may determine the property (such as the color) based on which of the contacts 56, 58, 60 interfaces with the mounting tab.

Further, the mechanical interaction of the mounting tab with the contact may provide mechanical support for the strobe cover 50. For example, the mounting tab may be mechanically connected to the base unit of the strobe device by being press-fitted or snapped into the one or more contacts on the base unit. In this way, the mounting tabs may provide mechanical support to the strobe cover 50 and provide an indicator of the property of the strobe cover 50 to the PCB electronics 62.

Figure 4A:
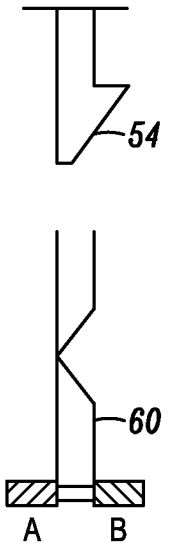
FIGS. 4A-B show a view of the mounting tab and contact along section A-A (as depicted in FIG. 3) with FIG. 4A illustrating the mounting tab and contact prior to contact, and with FIG. 4B illustrating the mounting tab and contact after contact.
Figure 4B:
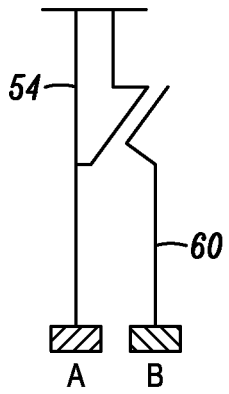

FIGS. 4A-B show a view of the mounting tab and contact along section A-A (as depicted in FIG. 3) with FIG. 4A illustrating the mounting tab and contact prior to contact, and with FIG. 4B illustrating the mounting tab and contact after contact. As shown in FIG. 4A, the contact 60 is closed prior to contact with the mounting tab 54 of strobe cover 50 (e.g., the "A" part of the contact is electrically connected to the "B" part of the contact). After mechanical contact, the mounting tab 54 separates the contact 60, as shown in FIG. 4B. The mounting tab may be made of a non-conductive material so that the contact 60 may be interpreted by the PCB electronics 62 as an open circuit. Alternatively, the contact may be a normally open contact. The mounting tab may be composed of an electrically conductive material so that upon contact, the mounting tab may electrically close the contact.

FIG. 5 illustrates an example of a strobe cover detection circuit in which individual dedicated comparators change state when the respective contact is closed. The contacts 56, 58, 60 are connected to respective pullup resistors R1, R2, R3 and to inputs to the negative input of comparator 1, comparator 2, comparator 3. A reference voltage (Ref) is input to the positive input of comparator 1, comparator 2, comparator 3. Closing a contact changes the output of the respective comparator, which is sent to controller 26. For example, a change in output of comparator 1 indicates to controller 26 a particular property, such as that the color of the strobe cover is clear. FIG. 5 depicts a strobe cover detection circuit for detecting the color of the strobe cover. However, the circuit in FIG. 5 may likewise be used to detect different properties of the strobe cover.

FIG. 6 illustrates another example of a strobe cover detection circuit in which a single comparator monitors a group of contacts against a level shifted reference. The positive input to comparator 68 includes a reference voltage that is periodically shifted. The shifted reference voltage may be output from controller 26. The three contacts 56, 58, 60 may be connected to preset voltage values (such as different voltage values of $V_1$, $V_2$, and $V_3$) and to the negative input to comparator 68. FIG. 6 depicts a strobe cover detection circuit for detecting the color of the strobe cover. However, the circuit in FIG. 6 may likewise be used to detect different properties of the strobe cover. As shown in FIG. 6, contact 56 indicates interfacing with the "clear" mounting tab on strobe cover 50, contact 58 indicates interfacing with the "amber" mounting tab on strobe cover 50, and contact 60 indicates interfacing with the "other colors" mounting tab on strobe cover 50. The controller 26 may shift the reference voltage, and then read the output to determine which of the contacts 56, 58, 60 are interfacing with the mounting tab. In this way, a state change of the comparator 68 indicates the property of the strobe cover 50, such as the color of the strobe cover 50.

Still another example of the strobe cover detection circuit 38 may include an analog to digital converter. For example, the analog voltage may be read from a circuit that includes the contacts 56, 58, 60, and the digital output from the A/D converter may be input to the controller 26. As another example, the analog voltage from the circuit that includes the contacts 56, 58, 60 may be input directly to the controller 26, which may include an internal A/D converter. The examples of the strobe cover detection circuit 38 are merely for illustration purposes.

Figure 7:
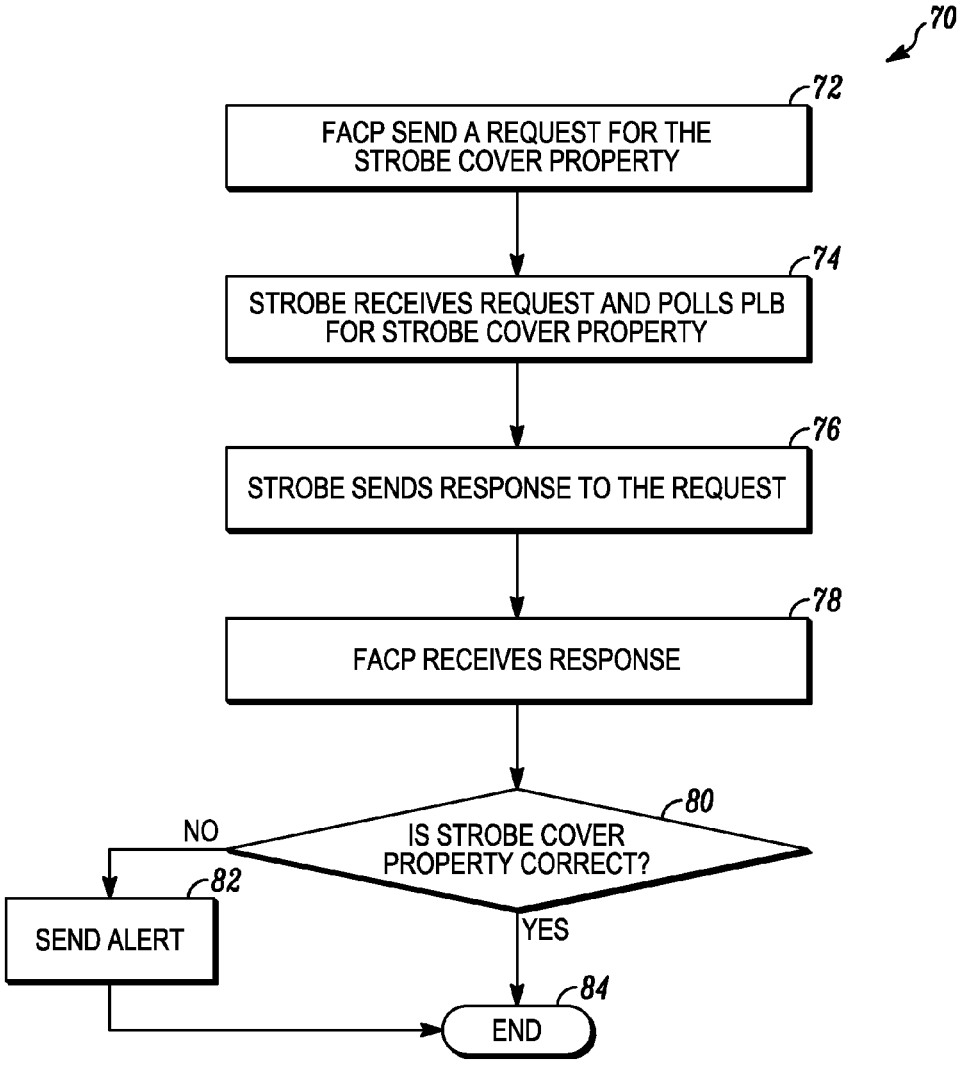
FIG. 7 is an example of a flow chart in which a command is sent from FACP to the strobe to determine the color of the strobe cover of the strobe.

FIG. 7 is an example of a flow chart 70 in which a command is sent from FACP to the strobe to determine at least one property of the strobe cover of the strobe device. At 72, the FACP sends a request for a report of the strobe cover property to one or more of the strobe devices. The FACP may use the processor 42 in combination with the user interface/configuration software to send the request for the report. At 74, one or more strobe devices receive the command and poll their respective PCB (or other electronics) to determine the strobe cover property (such as the strobe cover color). Alternatively, the strobe device may probe the PCB independently, store the determined property of the strobe cover, and report the stored determined property when requested by the FACP. At 76, the one device sends to the FACP a response to the request. The response to the FACP includes a field indicating the property of the strobe cover (such as the strobe cover color). At 78, the FACP receives the response. The FACP may then check whether the information in the response is correct, as shown at 80. For example, the FACP may compare the strobe cover property information (such as the strobe cover color information) in the response with historical strobe cover property information (such as historical strobe cover color information) stored in a memory, such as memory 44 illustrated in FIG. 2, of the FACP. The historical strobe cover property information stored in the memory 44 of the FACP may indicate the expected configuration of the fire alarm system (such as the expected colors of the strobe covers of one or more strobes in the fire alarm system). If the strobe cover is determined to be correct (the expected property matches the strobe cover property information sent from the strobe device), the process ends at 84. If the strobe cover is not determined to be correct, an alert may be sent at 82. For example, the alert may be sent to a user interface at or in communication with the FACP. The alert may also comprise an electronic communication to a device external to the FACP. The alert may indicate the error to the operator. The error may be due either to installation of an incorrect strobe cover or to improper configuration of the FACP.

While the invention has been described with reference to various embodiments, it should be understood that many changes and modifications can be made without departing from the scope of the invention. It is therefore intended that the foregoing detailed description be regarded as illustrative rather than limiting, and that it be understood that it is the following claims, including all equivalents, that are intended to define the spirit and scope of this invention.

The invention claimed is:

1. A strobe device comprising:

a strobe;

a communication interface;

a circuit configured to generate an output to send to the controller, the output indicative of a property of a strobe cover;

a strobe cover; and a controller in communication with the strobe, the circuit and the communication interface, the controller configured to:

receive, via the communication interface, a strobe property request from an external device; and responsive to receipt of the strobe property request, send, via the communication interface, data indicative of the property of the strobe cover to the external device.

2. The strobe device of claim 1, wherein the controller, responsive to receipt of the strobe property request, is configured to:

poll the circuit in order for the circuit to generate the output to send to the controller; and send the data indicative of the property of the strobe cover to a fire alarm control panel.

3. The strobe device of claim 1, wherein the property of the strobe cover comprises a color of the strobe cover.

4. The strobe device of claim 1, wherein a property indicator mechanically interfaces with the at least one element of the circuit.

5. The strobe device of claim 4, wherein the property indicator comprises a color indicator;

wherein the at least one element comprises a first element and a second element;

wherein the color indicator interfacing with the first element is indicative of a first color of the strobe cover; and wherein the color indicator interfacing with the second element is indicative of a second color of the strobe cover.

6. The strobe device of claim 1, wherein a property indicator electrically, magnetically, or optically interfaces with the at least one element of the circuit.

7. The strobe device of claim 1, wherein the circuit configured to generate the output comprises a light sensor.

8. The strobe device of claim 1, wherein the communication interface comprises a wireless communication interface configured to receive the strobe property request wirelessly from the external device.

9. The strobe device of claim 1, wherein the communication interface comprises a wired communication interface.

10. A device configured to wirelessly communicate with a strobe device, the device comprising:

a memory configured to store strobe cover property information;

a wireless communication interface; and a processor in communication with the memory and the communication interface, the processor configured to:

formulate a request to the strobe device, the request indicative of requesting the strobe device for a response that includes at least one property of a strobe cover of the strobe device;

transmit wirelessly, via the communication interface, the request to the strobe device;

receive the response from the strobe device, the response including data indicative of the at least one property of the strobe cover;

compare the data indicative of at least one property of the strobe cover with the strobe cover property information stored in the memory; and determining whether to issue an alert based on the comparison.

11. The device of claim 10, wherein the at least one property comprises color of the strobe cover.

12. The device of claim 11, wherein the processor is configured to compare the data indicative of at least one property of the strobe cover with the strobe cover property information stored in the memory by comparing color data in the response from the strobe device with color information stored in the memory of the device.

13. The device of claim 10, wherein the controller is further configured to, in response to determining to issue an alert, generate an output, indicative of the alert, for an operator of the device; and wherein the alert is indicative of an error in configuration of the strobe device.

14. A method for operating a strobe device, the method comprising:

generating, using a circuit of the strobe device, an output indicative of a property of a strobe cover of the strobe device;

receiving, via a communication interface of the strobe device, a strobe property request from an external device;

responsive to receipt of the strobe property request, sending, via the communication interface, data indicative of the property of the strobe cover to the external device.

15. The method of claim 14, wherein the communication interface comprises a wireless communication interface; and wherein the strobe property request is received wirelessly from the external device.

16. The method of claim 14, in response to receipt of the strobe property request, the a circuit of the strobe device generates the output indicative of the property of a strobe cover of the strobe device.

17. A method for a device to wirelessly communicate with a strobe device, the method comprising:

formulating a request to the strobe device, the request indicative of requesting the strobe device for a response that includes at least one property of a strobe cover of the strobe device;

transmitting wirelessly the request to the strobe device;

receiving the response from the strobe device, the response including data indicative of the at least one property of the strobe cover;

comparing the data indicative of at least one property of the strobe cover with the strobe cover property information stored in a memory of the device; and determining whether to issue an alert based on the comparison.

18. The method of claim 17, wherein the at least one property comprises color of the strobe cover.

19. The method of claim 18, wherein comparing the data indicative of at least one property of the strobe cover with the strobe cover property information stored in the memory comprises comparing color data in the response from the strobe device with color information stored in the memory of the device.

20. The method of claim 17, further comprising, in response to determining to issue an alert, generating an output, indicative of the alert, for an operator of the device; and wherein the alert is indicative of an error in configuration of the strobe device.

* * * * *